United States Patent [19]

Takai

[11] Patent Number: 4,872,815

[45] Date of Patent: Oct. 10, 1989

[54] SLANT PLATE TYPE COMPRESSOR WITH VARIABLE DISPLACEMENT MECHANISM

[75] Inventor: Kazuhiko Takai, Maebashi, Japan

[73] Assignee: Sanden Corporation, Gunma, Japan

[21] Appl. No.: 157,783

[22] Filed: Feb. 19, 1988

[30] Foreign Application Priority Data

Feb. 19, 1987 [JP] Japan ..... 62-36445

[51] Int. Cl.[4] ..... F04B 1/26; F04B 27/08

[52] U.S. Cl. ..... 417/222; 417/270

[58] Field of Search ..... 417/222, 270

[56] References Cited

U.S. PATENT DOCUMENTS

| | | | |
|---|---|---|---|
| 2,964,234 | 5/1954 | Loomis, III . | |
| 3,062,020 | 11/1962 | Heidorn | 417/222 X |
| 3,861,829 | 1/1975 | Roberts et al. . | |
| 4,037,993 | 7/1977 | Roberts . | |
| 4,073,603 | 2/1978 | Abendschein et al. . | |
| 4,174,191 | 11/1979 | Roberts . | |
| 4,175,915 | 11/1979 | Black et al. | 417/222 |
| 4,425,837 | 1/1984 | Livesay . | |
| 4,428,718 | 1/1984 | Skinner . | |
| 4,433,596 | 2/1984 | Scalzo . | |
| 4,475,871 | 10/1984 | Roberts . | |
| 4,480,964 | 11/1984 | Skinner . | |
| 4,492,527 | 12/1984 | Swain et al. . | |
| 4,526,516 | 7/1985 | Swain et al. . | |
| 4,543,043 | 9/1985 | Roberts . | |
| 4,586,874 | 5/1986 | Hiraga et al. . | |
| 4,606,705 | 8/1986 | Parekh . | |
| 4,664,604 | 5/1987 | Terauchi . | |
| 4,669,272 | 6/1987 | Kawai et al. . | |
| 4,674,957 | 6/1987 | Ohta et al. | 417/222 |
| 4,685,866 | 8/1987 | Takenaka et al. | 417/222 |
| 4,687,419 | 8/1987 | Suzuki et al. . | |
| 4,688,997 | 8/1987 | Suzuki et al. . | |
| 4,702,677 | 10/1987 | Takenaka et al. . | |
| 4,778,348 | 10/1988 | Kikuchi et al. . | |
| 4,782,712 | 11/1988 | Ito et al. | 417/269 |

FOREIGN PATENT DOCUMENTS

| | | |
|---|---|---|
| 219283 | of 0000 | European Pat. Off. . |
| 3603931 | of 0000 | Fed. Rep. of Germany . |
| 58158383 | of 0000 | Japan . |
| 2153922 | of 0000 | United Kingdom . |

*Primary Examiner*—William L. Freeh

*Attorney, Agent, or Firm*—Banner, Birch, McKie & Beckett

[57] ABSTRACT

A slant plate type compressor with a variable displacement mechanism includes a compressor housing having a cylinder block with a plurality of cylinders which are associated with a suction chamber. The compressor also comprises a crank chamber adjacent the cylinder block, a piston slidably received within each of the cylinders, and a drive mechanism coupled to the cylinders. The drive mechanism includes a drive shaft rotatably supported in the housing, a rotor coupled to the drive shaft and rotatable therewith, and a coupling mechanism for drivingly coupling the rotor to the pistons such that the rotary motion of the rotor is converted into reciprocating motion of the pistons. The coupling mechanism includes a member having a surface disposed at an incline angle relative to the drive shaft wherein the incline angle is adjustable to vary the stroke length of the pistons and the capacity of the compressor. The coupling mechanism also includes a hinge mechanism between the rotor and the incline member. The hinge mechanism includes a first arm portion extending from the rotor. The first arm portion includes a guide pin secured thereto for cooperation with a slot formed in a second arm portion extending from the incline member. The center of the guide pin is positioned between the center line of one of the cylinders and the center line of the drive shaft. The position of the guide pin permits rapid return of the inclined member to its maximum angular orientation in response to the difference between crank and suction chamber pressures without assistance for other mechanisms such as a return spring.

8 Claims, 4 Drawing Sheets

SLANT PLATE TYPE COMPRESSOR WITH VARIABLE DISPLACEMENT MECHANISM

FIELD OF THE INVENTION

The present invention relates to a slant plate type compressor with a variable displacement mechanism, and more particularly, to a hinge mechanism for enabling such variable displacement.

BACKGROUND OF THE INVENTION

Slant plate type compressors such as wabble plate type compressors which reciprocate pistons by converting the rotational motion of a cam rotor into nutational motion of a wobble plate are well known in the art. Such a variable displacement wobble plate compressor is disclosed in Japanese Patent Application Publication No. 58-158,382. Changing the inclined angle of the wobble plate changes the stroke of the pistons and therefore changes the displacement volume of the cylinders.

Referring to FIG. 1, the construction of a conventional wobble plate type compressor is shown. Wobble plate type compressor 1 includes front end plate 2, cylinder casing 3 having cylinder block 31, valve plate 4 and cylinder head 5. Front end plate 2 is fixed on one end of cylinder casing 3 by securing bolts 6. Axial hole 21, which is formed through the center of front end plate 2, receives drive shaft 7. Radial bearing 8 is disposed in axial hole 21 to rotatably support drive shaft 7. Annular sleeve portion 22 projects form front end plate 2 and surrounds drive shaft 7, thereby defining a seal cavity. Cylinder casing 3 is provided with cylinder block 31 and crank chamber 32. Cylinder block 31 has a plurality of equiangularly spaced cylinders 33 formed therein.

Cam rotor 9 is fixed on drive shaft 7 by pin 103. Thrust needle bearing 10 is disposed between the inner wall surface of front end plate 2 and the adjacent axial end surface of cam rotor 9. Arm portion 91 of cam rotor 9 extends in a direction toward cylinder block 31. Elongated hole or slot 92 is formed on arm portion 91. Inclined plate 11, provided with flange portion 111, arm portion 112 and cylindrical portion 113, is disposed around drive shaft 7. Arm portion 112 is formed on the outer surface of flange portion 111 of inclined plate 11 and faces arm portion 91 of cam rotor 9. A hole (not shown) which is formed in arm portion 112, is aligned with elongated hole or slot 92. In operation, guide pin 12 is fixedly inserted in the hole so that a projection therefrom is slidably movable within elongated hole 92. Ring shaped wobble plate 13 is mounted on the outer surface of cylindrical portion 113 of inclined plate 11 through radial bearing 14 and is prevented from axial movement by flange portion 111 and snap ring 15 which is disposed on cylindrical portion 113. Wobble plate 13 is also prevented from rotating by guide plate 25 which extends within crank chamber 32. Thrust needle bearing 16 is disposed in a gap between flange portion 111 and wobble plate 13. The outer end of drive shaft 7 is rotatably supported through radial bearing 17 in the central bore 34 of cylinder block 31. One end of piston rod 13 is rotatably connected to receiving surface 131 of wobble plate 13. The other end of piston rod 18 is rotatably connected to piston 19 which is slidably fitted within cylinder 33.

Suction ports 41 and discharge ports 42 are formed through valve plate 4. A suction reed valve (not shown) and a discharge reed valve (not shown) are oppositely disposed on valve plate 4. Cylinder head 5 is connected to cylinder casing 3 through gaskets (not shown) and valve plate 4. Partition wall 51 extends axially from the inner surface of cylinder head 5 and divides the interior of cylinder head 5 into annular suction chamber 52 and discharge chamber 53. Annular suction chamber 52 is connected to the external fluid circuit through fluid inlet port 54 formed in cylinder head 5. Discharge chamber 53 is connected to the external fluid circuit through fluid outlet port 55 formed in cylinder head 5.

Crank chamber 32 of cylinder casing 3 and suction chamber 52 of cylinder head 5 are connected to one another through conduit 311 to control the angle of inclined plate 11 and wobble plate 13. Conduit 311, formed within cylinder block 31, communicates crank chamber 32 of cylinder casing 3 with suction chamber 52 of cylinder head 5 through central bore 34, formed within cylinder block 31, and hollow portion 312. Thus, conduit 311 introduces the fluid gas in crank chamber 32 to suction chamber 52 in response to operation of control valve 20. Control valve 20 controls the opening and closing of conduit 311 in response to the difference between the gas pressure in crank chamber 32 and that in suction chamber 52. The angle of inclination of inclined plate 11 and wobble plate 13 is dependent on the fluid pressure in crank chamber 32. If the communication between crank chamber 32 and suction chamber 52 is prevented by closing control valve 20, fluid pressure in crank chamber 32 gradually increases. The high fluid pressure in crank chamber 32 acts on the rear surface of pistons 19 thereby reducing the angle of inclination of inclined plate 11 and wobble plate 13. The capacity of the compressor is also reduced. On the other hand, if crank chamber 32 and suction chamber 52 are in communication with each other, as when control valve 20 is open, fluid pressure in crank chamber 32 is reduced thereby affecting the increase in the angle of inclination of inclined plate 11 and wobble plate 13. The capacity of the compressor is increased as well.

A conventional hinge mechanism includes arm portion 91 extending from cam rotor 9 and having elongated hole or slot 92 therein, and arm portion 112 extending from inclined plate 11 and having guide pin 12 secured thereto. Hole or slot 92 cooperates with pin 12.

The aforementioned hinge mechanism is depicted in FIG. 2 in a first position wherein inclined plate 11 and wobble plate 13 form a large angle with a vertical axis generally being substantially normal to the longitudinal axis of drive shaft 7. FIG. 3 shows the same mechanism in a second position wherein the angle is significantly reduced with plates 11 and 13 approximately upright. The mechanics are as follows. Since guide pin 12 is fixedly disposed in a hole formed in arm portion 112 of inclined plate 11, guide pin 12 gradually approaches drive shaft 7 as the angle of inclined plate 11 is reduced. The distance L between the central axis of drive shaft 7 and the center of guide pin 12 is also reduced. Resultant force; and Fpi, which is the resultant force of the reaction force against the compression force of piston 19, is not influenced significantly relative to the magnitude and operating point thereof, even though the angle of inclined plate 11 changes. However, moment M for changing the angle of inclined plate 11 from $$M = \Sigma Fpi.Le$$

wherein Le is the distance difference between L and Lf, and Lf is the distance between the central axis of drive shaft 7 and the operating point of resultant force Fpi.

As mentioned above, if guide pin 12 is fixed at the side of inclined plate 11, and the angle of inclined plate 11 is reduced, then Le is reduced as well as moment M. Thus, inclined plate 11 cannot be rapidly returned to the position at which the angle of inclined plate 11 maximizes. As one solution to this problem, a return spring has been used for increasing the angle of inclined plate 11. Such is disclosed in Japanese Patent Application Publication No. 61-261,681.

SUMMARY OF THE INVENTION

It is a primary object of this invention to provide a slant plate type compressor with a variable displacement mechanism including a hinge having a means for rapidly returning the inclined plate to maximum angular orientation in response to fluid or gas pressure reduction in the crank chamber.

It is another object of this invention to provide a slant plate type compressor with a variable displacement mechanism which has a hinge of simple construction thereby enabling greater manufacturing efficiencies.

It is yet a further object of this invention to provide a slant plate type compressor with a variable displacement mechanism which has a hinge mechanism providing improved compressor durability thereby reducing compressor repair needs and increasing compressor life.

The present invention is directed to a slant plate type compressor with a variable displacement mechanism. The compressor includes a compressor housing having a cylinder block with a plurality of cylinders which are associated with a suction chamber. The compressor also comprises a crank chamber adjacent the cylinder block, a piston slidably received within each of the cylinders, and a drive mechanism coupled to the cylinders. The drive mechanism includes a drive shaft rotatably supported in the housing, a rotor coupled to the drive shaft and rotatable therewith, and a coupling mechanism for drivingly coupling the rotor to the pistons such that the rotary motion of the rotor is converted into reciprocating motion of the pistons. The coupling mechanism includes a member having a surface disposed at an incline angle relative to the drive shaft wherein the incline angle is adjustable to vary the stroke length of the pistons and the capacity of the compressor. The coupling mechanism also includes a hinge mechanism between the rotor and the incline member. The hinge mechanism includes a first arm portion extending from the rotor. The first arm portion includes a guide pin secured thereto for cooperation with a slot formed in a second arm portion extending from the incline member. The center of the guide pin is positioned between the center line of one of the cylinders and the center line of the drive shaft. The position of the guide pin permits rapid return of the inclined member to its maximum angular orientation in response to the difference between crank and suction chamber pressures without assistance from other mechanisms such as a return spring.

Further objects, features and other aspects of the invention will be understood from the following description of the preferred embodiments of the invention referring to the attached drawings.

DETAILED DESCRIPTION

Figure 1:
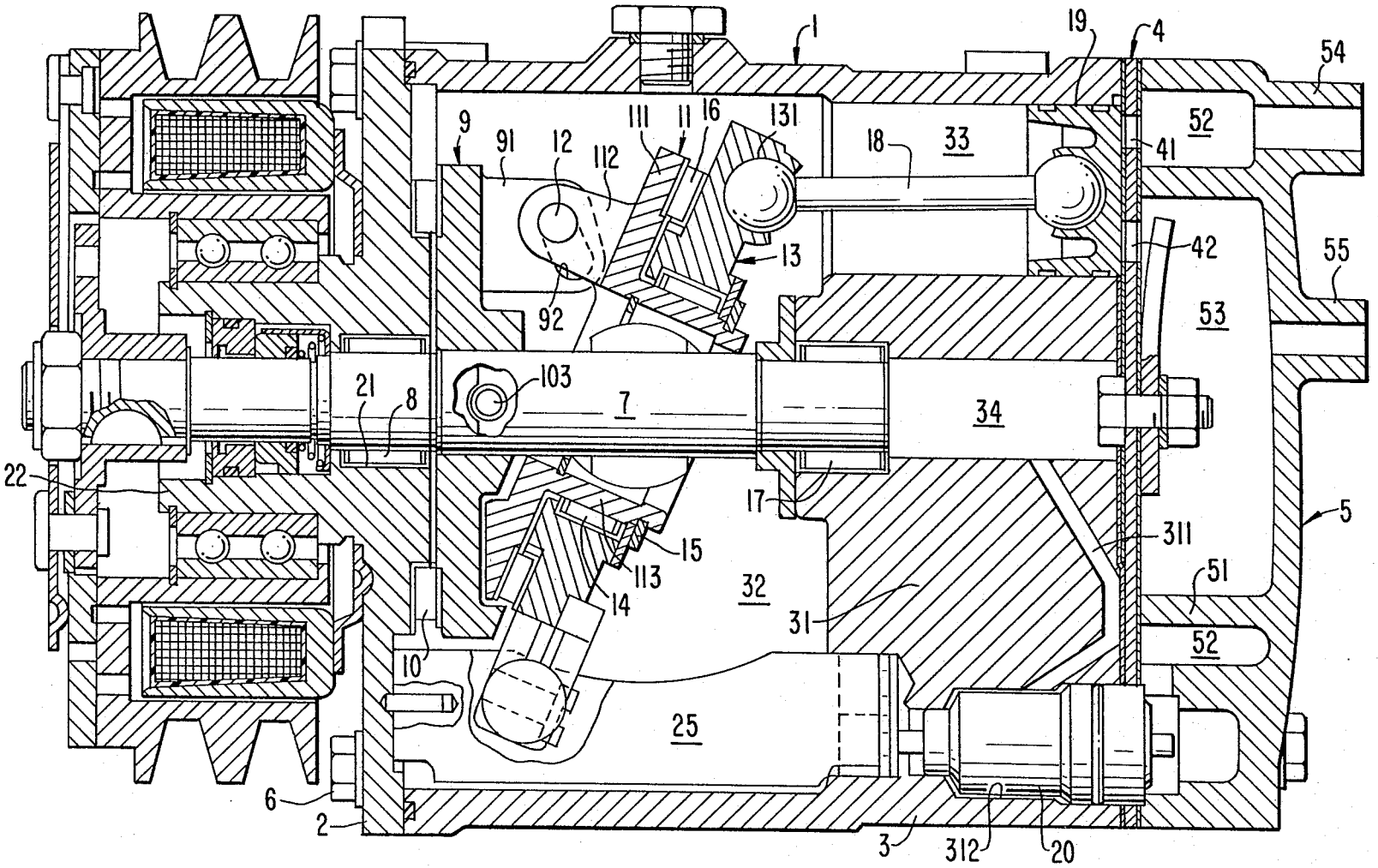
FIG. 1 PRIOR ART
FIG. 1 is a cross-sectional view of a conventional wobble plate type compressor with a variable displacement mechanism.
Figure 2:
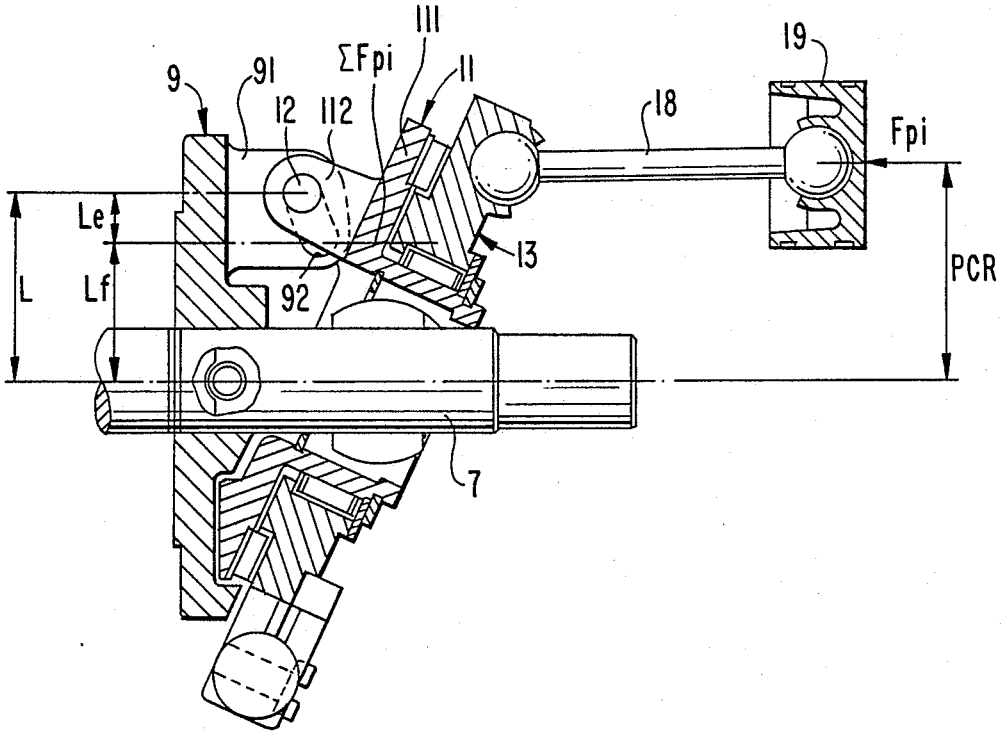
FIG. 2 PRIOR ART
FIG. 2 is a perspective view of the drive mechanism of FIG. 1 including a conventional hinge mechanism in the position wherein the angle of the inclined plate is at a maximum.
Figure 3:
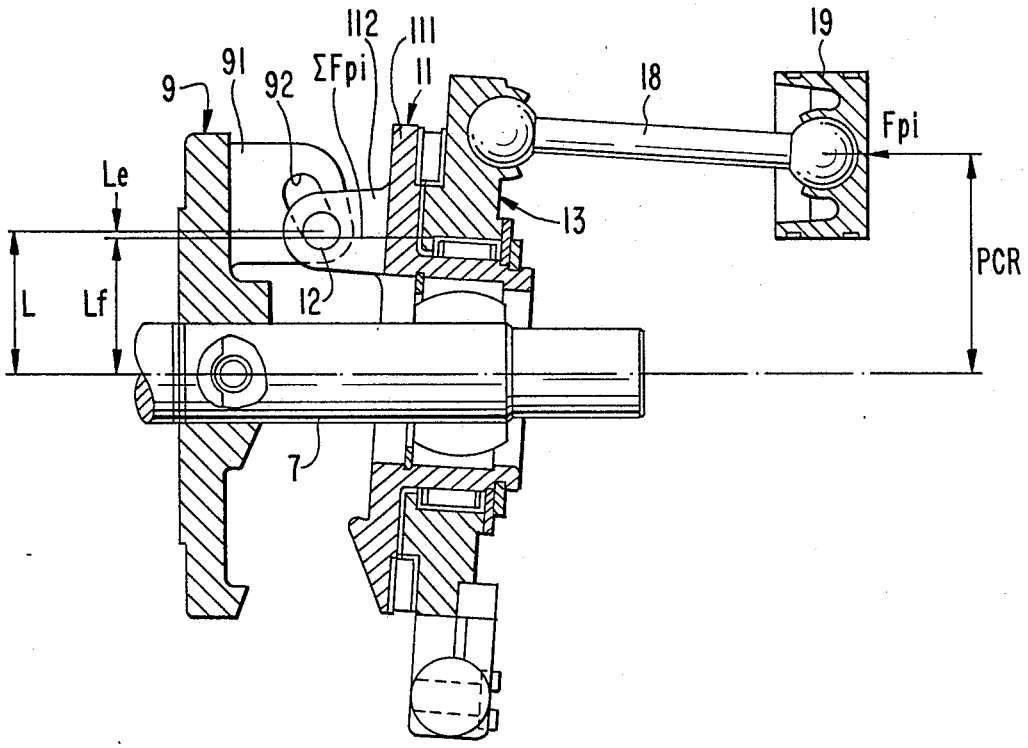
FIG. 3 PRIOR ART
FIG. 3 is a perspective view of the drive mechanism of FIG. 1 including a conventional hinge mechanism in the position wherein the angle of the inclined plate is at a minimum.
Figure 4:
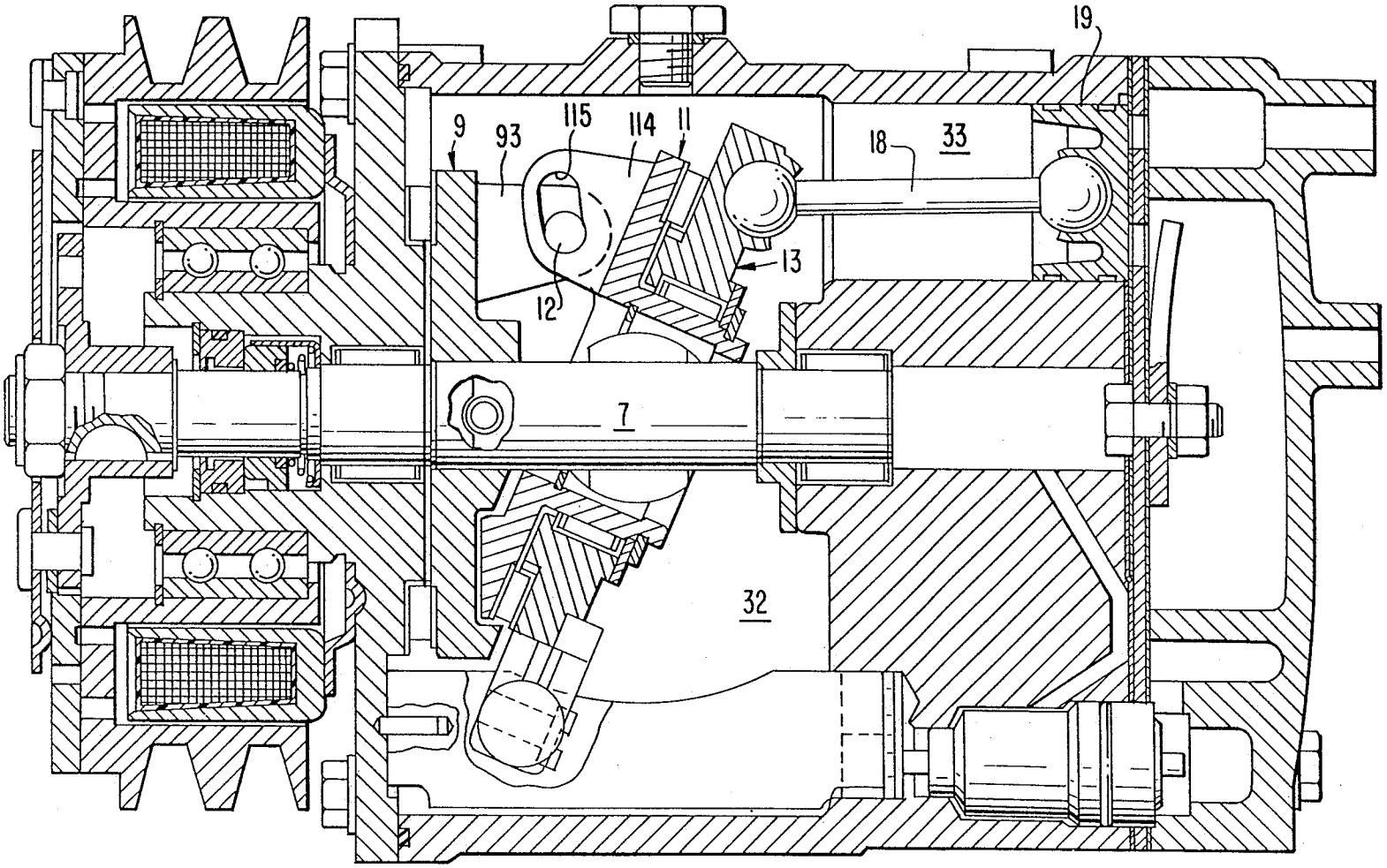
FIG. 4 is a cross-sectional view of a wobble plate type compressor with a variable displacement mechanism in accordance with one embodiment of this invention.

FIG. 4 depicts the construction of a wobble plate type compressor with a variable displacement mechanism in accordance with the preferred embodiment of this invention. The same numerals are accorded on the same construction as that shown in FIG. 1 and the description of that construction is omitted to simplify the description herein.

The hinge mechanism in accordance with this invention includes a first arm portion 93 extending from cam rotor 9, guide pin 12 fixedly disposed in a hole formed in first arm portion 93, and a second arm portion 114 extending from inclined plate 11 and having elongated hole or slot 115 formed therein. FIG. 4 further depicts hinge pin 12 being operatively associated with slot 115.

Figure 5:
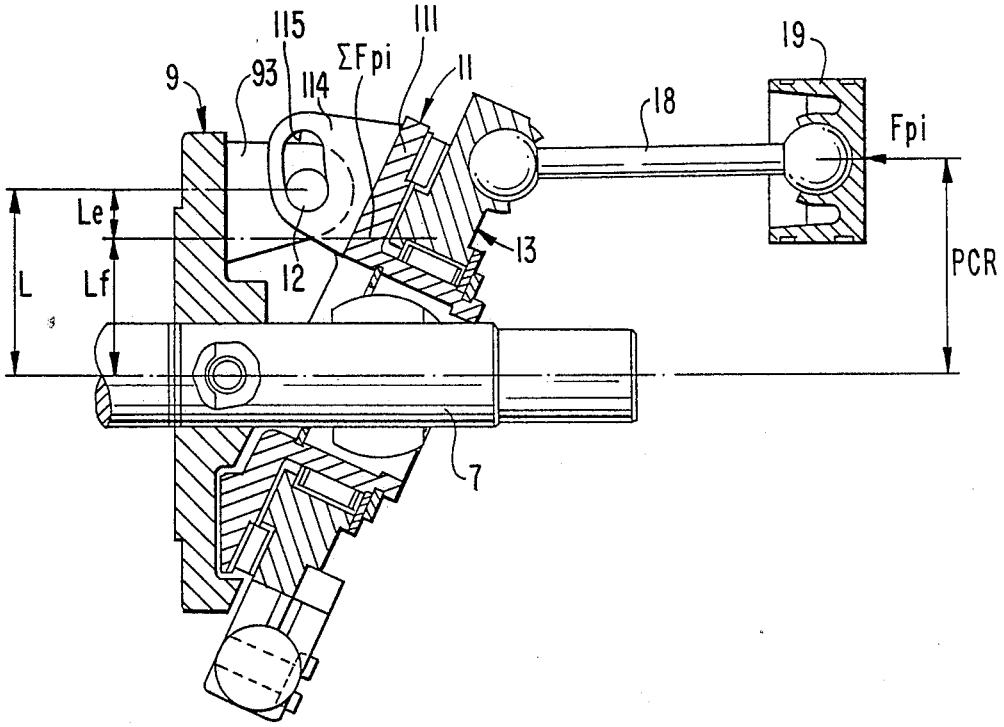
FIG. 5 is a perspective view of the drive mechanism of FIG. 4 showing the hinge mechanism in accordance with this invention in the position wherein the angle of the inclined plate is at a maximum.
Figure 6:
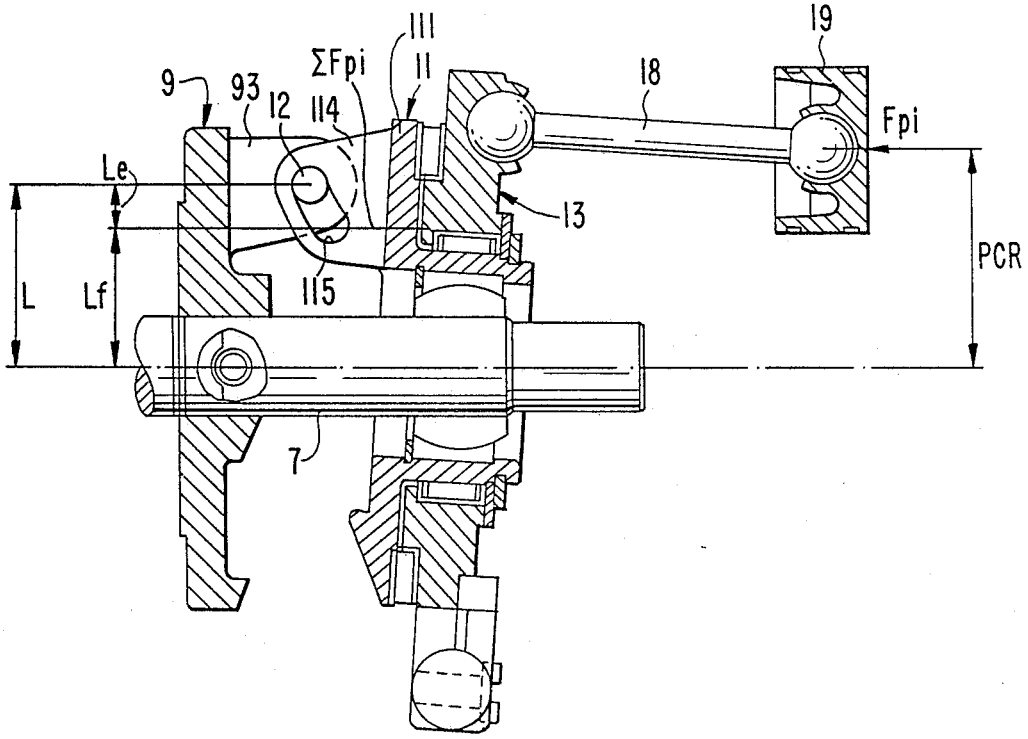
FIG. 6 is a perspective view of the drive mechanism of FIG. 4 showing the hinge mechanism in accordance with this invention in the position wherein the angle of the inclined plate is at a minimum.

FIG. 5 and 6 show the construction of a drive mechanism including the above hinge mechanism. The angle of inclined plate 11 and wobble plate 13 is varied in accordance with changes of the gas pressure in crank chamber 32 and corresponding movement of piston 19. The angle of inclined plate 11 varies within the dimensional boundaries of elongated slot 115 in accordance with gas pressure in crank chamber 32. When guide pin 12 interacts with these boundaries, the guide pin prevents further motion of inclined plate 11. Since guide pin 12 is fixed on first arm portion 93, the position of guide pin 12 is not moved. Therefore, the distance L between the central axis of drive shaft 7 and the center of guide pin 12 is not changed. The operating point of resultant force ΣFpi also is not changed even though the angle of inclined plate 11 is changed. Accordingly, Lf, the distance between the central axis of drive shaft 7 and operating point of resultant force ΣFpi, is not significantly changed. It follows that distance Le is substantially maintained at a fixed value in spite of variation of the angle of inclined plate 11. Therefore, moment M determined from the aforementioned equation, is also maintained at a substantially fixed value independent of variation of the angle of inclined plate 11. Thus, inclined plate 11 can be returned to the position of maximum angle from the position of minimum angle without using a further element for returning inclined plate 11, such as a return spring.

According to one experiment, if L, the distance between the central axis of drive shaft 7 and the center of guide pin 12, is selected from within the range and inclusive of 78–90 percent of the distance between the central axis of drive shaft 7 and the central axis of cylinder 33, the angle of inclined plate 11 is easily increased even though substantial fluid pressure changes in crank chamber 32 do not act on the rear surface of piston 19. If distance L is selected as mentioned above, Pe, the pressure difference between Pc (pressure in crank chamber 32) and Ps (pressure in suction chamber 52), which is needed to reduce and increase the angle of inclined plate 11, is determined from the following equation;

$$Pe = 0.5 \sim 1.0 \text{ kg/cm}^2 \pm \Delta P \text{ kg/cm}^2$$

wherein ΔP is additional pressure needed for moving inclined plate 11 in axial directions.

When ΔP is added to the other value in the above equation, the angle of inclined plate 11 reaches its minimum. When ΔP is subtracted from the other value, the angle of inclined plate 11 reaches its maximum. Accordingly, it is not necessary to use a high pressure difference (Pe). Therefore, the preferred wobble plate type compressor utilizes a variable displacement mechanism which operates at lower pressures and working forces thereby providing increased durability.

Although illustrative embodiments of the invention have been described in detail with respect to the accompanying drawings, it is to be understood that the invention is not limited to those precise embodiments, and that various changes and modifications may be effected therein by one skilled in the art without departing from the scope of the invention.

I claim:

1. In a wobble plate type compressor with a variable displacement mechanism, the compressor comprising a compressor housing having a cylinder block provided with a plurality of cylinders which in turn are associated with a suction chamber, said compressor also having a crank chamber adjacent the cylinder block, a drive shaft rotatably supported in the housing, a cam rotor fixed on the drive shaft and further connected to an inclined plate wherein the connection comprises a hinge means for providing variable inclination of the inclined plate with respect to the drive shaft, a wobble plate adjacent the inclined plate, rotational motion of the inclined plate being converted into nutating motion of the wobble plate, and a plurality of pistons coupled with the wobble plate each of which is reciprocably fitted within a respective one of the cylinders and of which the stroke volume is changed in accordance with variation of the angle of the inclined plate, the improvement comprising:

said hinge means comprising return means for permitting the inclined plate to rapidly return to its maximum angular orientation, which maximizes said stroke volume, solely in response to the difference between crank chamber pressure and suction chamber pressure, said return means including a first arm portion extending from the cam rotor, said first arm portion having a guide pin fixedly secured thereto, wherein the distance between the center of said guide pin and the central axis of said drive shaft is selected from within the range and inclusive of 78–90 percent of the distance between the central axis of at least one of said cylinders and the central axis of said drive shaft and the distance between the guide pin and the central axis of the shaft substantially remaining constant during variation of the angle of the inclined plate.

2. The wobble plate type compressor of claim 1 wherein the return means further comprises a second arm portion extending from the inclined plate and having an elongated slot formed therein.

3. The wobble plate type compressor of claim 2 wherein a hole is formed in the first arm portion and the guide pin is fixedly disposed in the hole.

4. The wobble plate type compressor of claim 3 wherein the guide pin is inserted into the elongated slot.

5. In a wobble plate type compressor with a variable displacement mechanism, the compressor comprising a compressor housing having a cylinder block provided with a plurality of cylinders and a crank chamber adjacent the cylinder block, a drive shaft rotatably supported in the housing, a cam rotor fixed on the drive shaft and further connected to an inclined plate wherein the connection comprises a hinge means for providing variable inclination of the inclined plate with respect to the drive shaft; a wobble plate adjacent the inclined plate, rotational motion of the inclined plate being converted into nutating motion of the wobble plate, and a plurality of pistons coupled with the wobble plate each of which is reciprocably fitted within a respective one of the cylinders and of which the stroke volume is changed in accordance with variation of the angle of the inclined plate, the improvement comprising:

said hinge means having a first arm portion, said first arm portion extending from the cam rotor and having a guide pin fixedly secured thereto wherein the distance between the center of said guide pin and the central axis of said drive shaft is selected from within the range and inclusive of 78–90 percent of the distance between the central axis of any one of said cylinders and the central axis of said drive shaft, thereby further enabling the inclined plate to be rapidly returned to its maximum angular orientation, which maximizes said stroke volume, in response to pressure reduction in the crank chamber.

6. The wobble plate type compressor of claim 5 wherein said hinge means further comprises a second arm portion extending from the inclined plate and having an elongated slot formed therein for receiving the guide pin.

7. A slant plate type compressor with a variable displacement mechanism, the compressor comprising a compressor housing having a cylinder block with a plurality of cylinders which are associated with a suction chamber, said compressor also having a crank chamber adjacent said cylinder block, a piston slidably received within each of the cylinders, a drive mechanism coupled to said pistons to reciprocate said pistons within the cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of the compressor, the improvement comprising:

said coupling means further comprising hinge means between the rotor and said member for permitting said member to rapidly return to its maximum angular orientation solely in response to the difference between crank chamber pressure and section chamber pressure, said hinge means comprising a first arm portion extending from said rotor and including a guide pin secured thereto for operative association with said member, wherein the distance between the center of said guide pin and the central axis of said drive shaft is selected from within the range and inclusive of 78–90 percent of the distance between the central axis of at least one of said cylinders and the central axis of said drive shaft

8. The slant plate type compressor of claim 7 wherein said hinge means further comprises a second arm portion extending from said member and having a slot formed therein for receiving said guide pin.

* * * * *